US005811896A

United States Patent [19]

Grad

[11] Patent Number: 5,811,896

[45] Date of Patent: Sep. 22, 1998

[54] SWITCHING DEVICE

[75] Inventor: Boris Grad, 240 California St., Newton, Mass. 02158

[73] Assignee: Boris Grad, Hopkinton, Mass.

[21] Appl. No.: 759,728

[22] Filed: Dec. 6, 1996

[51] Int. Cl.[6] ..... H01H 36/00

[52] U.S. Cl. ..... 307/125; 307/116; 324/419; 335/151; 335/153; 362/123

[58] Field of Search ..... 307/125, 116; 335/205, 151, 153; 324/419; 362/123

[56] References Cited

U.S. PATENT DOCUMENTS

| | | | |
|---|---|---|---|
| 3,974,469 | 8/1976 | Nicholls | 335/153 |
| 3,976,962 | 8/1976 | Seeley | 335/153 |
| 4,210,888 | 7/1980 | Holce | 335/207 |
| 4,825,181 | 4/1989 | Nagano | 335/205 |
| 4,938,730 | 7/1990 | Yamane | 446/130 |
| 5,118,196 | 6/1992 | Ault et al. | 362/123 |
| 5,438,869 | 8/1995 | Mueller et al. | 335/153 |

OTHER PUBLICATIONS

Authors: Takao Yano, Chihiro Kawakita, Masaharu Yasuda, Kunio Hinohara Title: "Reed Switches", Publication of OKI Electric Industry, 1987; pp. 3–5, 6–34.

*Primary Examiner*—Ronald W. Leja
*Assistant Examiner*—Albert W. Paladini

[57] ABSTRACT

A switching device (10) for an electrical load, particularly for an electrical toy compraising a normally open reed switch (14) and a fixed biasing magnet (15) located at a distance from the glass tube (17) of the reed switch such that the magnetic strength of the biasing magnet in the area of the reed switch has value less than required for switching on of the reed switch and greater than required for switching off of the same switch.

The switch can be actuated—closed by applying to this switch an additional magnetic field the same orientation as the biasing magnetic field; the reed switch is closed and remains closed after removing the magnetic field.

This switch can be deactuated—opened by applying to the switch a magnetic field with orientation opposite to the orientation of the biasing magnetic field; the reed switch is opened and remains opened after removing the magnetic field.

17 Claims, 7 Drawing Sheets

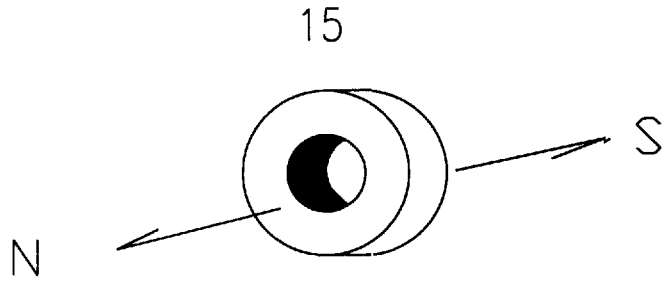
Fig. 4
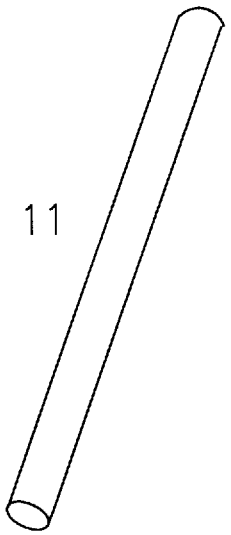
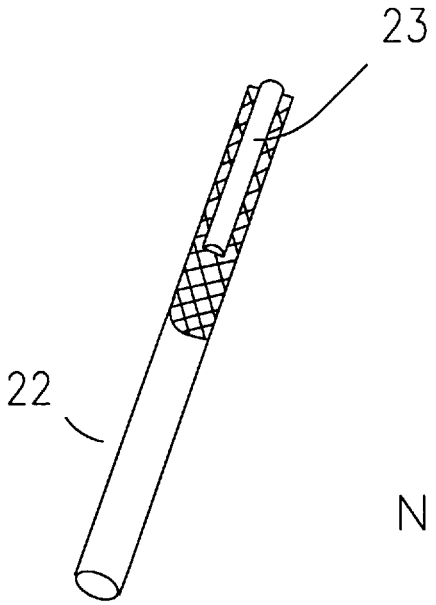
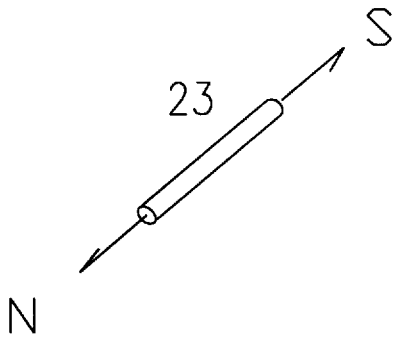
Fig. 6
Fig. 5 Fig. 5A

SWITCHING DEVICE

BACKGROUND

1. Field of the Invention

The present invention relates to the switching device for an electrical load, particularly for an electrical toys, including Christmas Tree Lights.

2. Description of Prior Art

As well known, an ordinary reed switch and a permanent magnet can be used as a switching device for various electrical loads. Contacts of an ordinary reed switch which uses a soft magnetic material like 52-alloy as the blade material close when a magnetic field is applied to the switch and open again when the magnetic field is removed. Prior to this invention the switching devices that utilize the ordinary reed switch have required the use of some additional devices for latching and unlatching the switch.

So, the switching device used for control of Christmas tree lights employing the reed switch and a "magic" magnetic wand was shown in the U.S. Pat. No. 5,118,196 to Ault and Atkins (1992). This switching device utilizes not only the reed switch but also requires the use of several additional devices for latching and unlatching the switch. It also needs a special power supply and a timer and requires holding the magnetic wand close to the reed switch during a specified time segment. This device for connecting an electrical toy to a power source is very expensive and inefficient.

The switching devices shown in U.S. Pat. No. 4,210,888 to Holce (1980) and in U.S. Pat. No. 3,974,469 (1976) to Nicholls utilize the reed switch and a biasing magnet, which is used only for increasing sensitivity of the switch.

The switching device shown in U.S. Pat. No. 4,825,181 to Nagano (1989) comprises a reed switch and a bias magnet used for stable operation of the switch.

None of the switching devices shown above provide latching and unlatching the switch, and therefore, require some additional devices for this purpose.

Japanese company OKI Electric industry Co. provides research into a reed switch, which uses a semi-hard magnetic material like Remendur as the blade material. Once its contacts close by a magnetic field being applied, they remain closed after magnetic field is removed due to the large residual magnetization. They remain closed unless a reverse magnetic field is applied to cancel the magnetization of the blades.

As it is mentioned in the publication of OKI Electric Industry Co. "Reed Switches", p. 6–34, various semi-hard magnetic materials have some problems in the magnetic characteristics, formability, contact plateability, and sealing properties. Moreover, since they contain cobalt, an expensive material, the material cost is very high.

OBJECTS AND ADVANTAGES

Accordingly, the following objects and advantages of the present invention containing a switching device will be shown.

The most advantageous and unique difference in this invention is the switching device for an electrical load, in particular, an attractive switching device for connecting and disconnecting any electrical toy including Christmas Tree lights to a power source. The control of the switching device is provided by simply moving the magnetic wand close to the switch. The switching device is latched and unlatched by the magnetic field of the wand and does not require additional latching and unlatching devices, does not need a special power supply and a timer, and does not require holding the "magic" wand near the switch for a specified time segment.

Because of its simplicity and low cost, this switch has immediate applications in high volume consumer goods devices such as switching Christmas Tree Lights or activating/deactivating various electrical toys.

Its applications are not limited strictly to toys—it can be used in any application where electrical power must be switched between any source (AC or DC) and its load at various power levels.

Further objects and advantages of my invention will become apparent from a consideration of the drawings and ensuing description.

SUMMARY OF THE INVENTION

The object of the invention is the inexpensive and simple switching device for electrically connecting and disconnecting an electrical load, particularly any electrical toy to/from a power source. A child or an adult may turn on or turn off an electrical toy by simply moving the magnetic wand near the switching device.

DRAWING FIGURES

FIG. 4 is a magnetization pattern of the biasing magnet.

FIG. 5 shows an external view of a magic wand.

FIG. 5A shows a sectional view of the wand.

FIG. 6 shows a magnetization pattern of a wand magnet.

REFERENCE NUMERALS IN DRAWINGS

Figure 1:
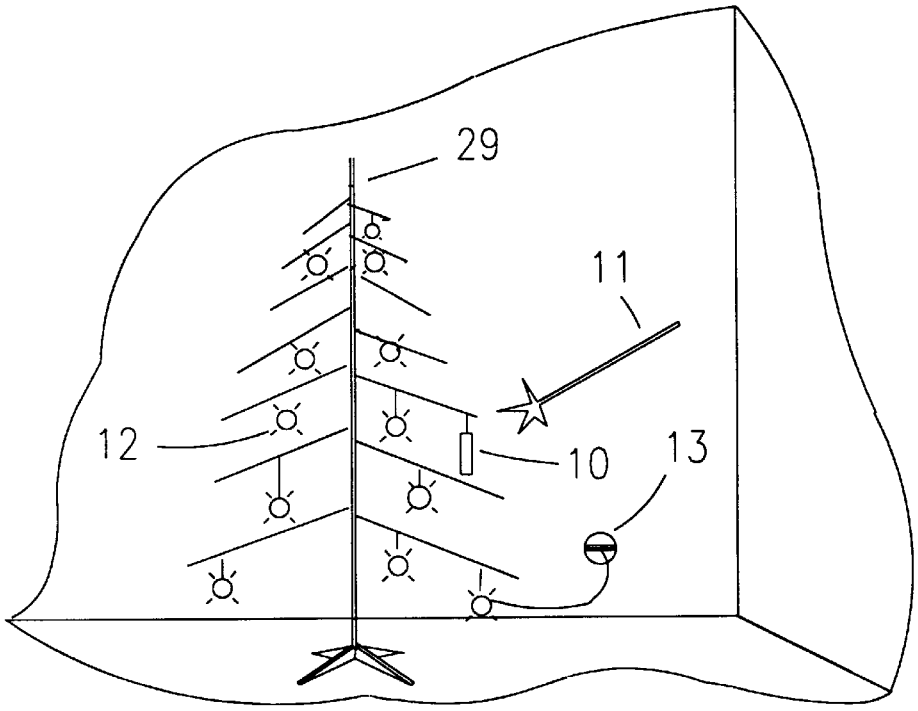
FIG. 1 is a view of the Christmas Tree Lights for illustrating an application of the switching device.

10 switching device
11 magnetic wand means
12 load—Christmas Tree lights
12a load—Light inside the Doll House
12B load with a current exceeding the current carrying capacity of the reed switch
13 AC power source

13A battery power source
14 normally open reed switch
15 biasing magnet
16 first blade
16A second blade
17 glass tube
18 contact of blade 16
18A contact of the blade 16A
19 reed of the blade 16
19A reed of the blade 16A
20 lead of the blade 16
20A lead of the blade 16A
21 housing
22 handle
23 magnet
24 amplifying device
25 control terminal of the amplifying device
26 resistor
27 main power source
28 control power supply
29 Christmas Tree
30 Doll House Description—FIGS. 1–11

Figure 8:
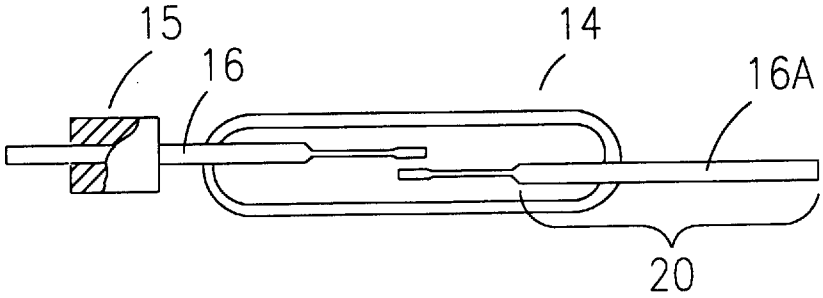
FIG. 8 shows the switch with a fixed lead.
Figure 9:
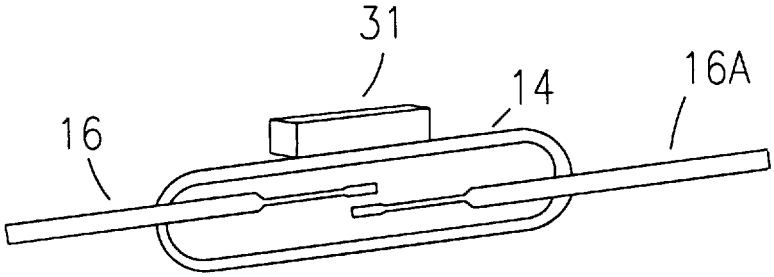
FIG. 9 shows the reed switch with a bar type biasing magnet.
Figure 10:
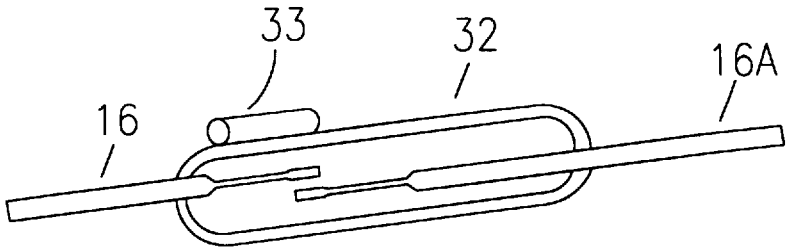
FIG. 10 shows the switch with a rod type biasing magnet.

FIG. 8 shows the switching device comprising a reed switch 14 and a ring type biasing magnet 15 fixed on the lead 20 of the reed switch. FIG. 9 shows the switching device comprising reed switch 14 and a bar type biasing magnet 31. FIG. 10 shows the switching device comprising a reed switch 32 and a rod type biasing magnet 33. The reed switch 14 in FIG. 8, 9 is a center type reed switch. The reed switch 32 in FIG. 9 is an offset type reed switch. All these reed switches 14, 32 use a soft magnetic material of the blades 16, 16A. These reed switches have a wide range between Pull In and Drop Out value, which allows for a simple choice of location for installation of the biasing magnet. The biasing magnet has to be located in the hysteresis area of the reed switch and displaced near the Pull In position of the reed switch. It provides stable operation of the reed switch as a latching switch from external magnetic field. When external magnetic field is applied to this switching device reed switch is latched ON or OFF, depending on the direction of the external magnetic field.

Figure 1A:
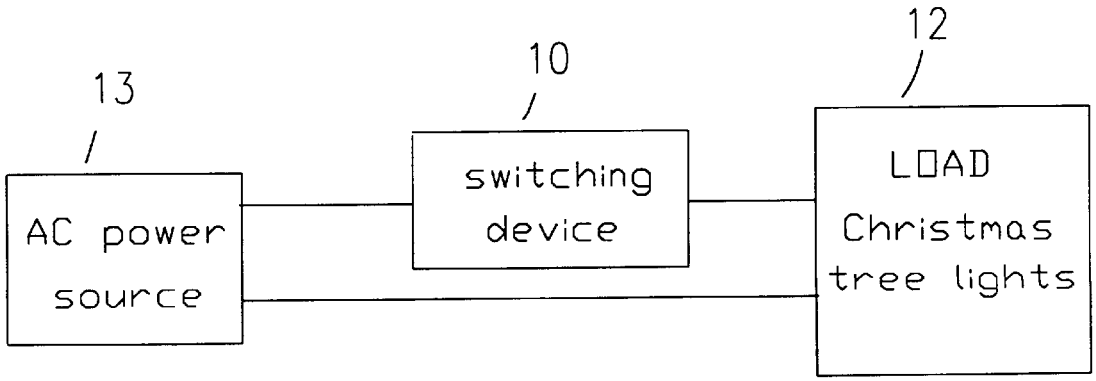
FIG. 1A is a schematic diagram of the Christmas tree lights.
Figure 2:
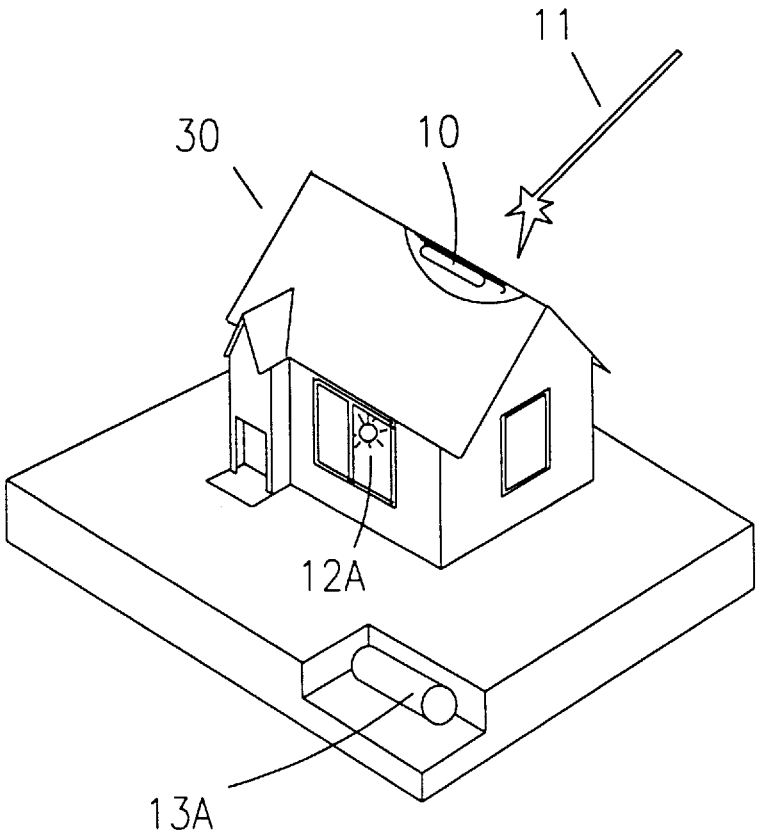
FIG. 2 is a view of a Doll House for illustrating a second application of the switching device.

FIGS. 1 and 2 show the switch energizing two typical applications—a set of Christmas tree lights and a Doll House. FIG. 1A shows a circuit diagram of the Christmas tree lights and FIG. 2A shows a circuit diagram of a light inside the Doll House.

A preferred embodiment of the present invention comprises a switching device 10, which is activated and deactivated by a magnetic wand 11 and connects and disconnects a load to/from a power source.

Figure 2A:
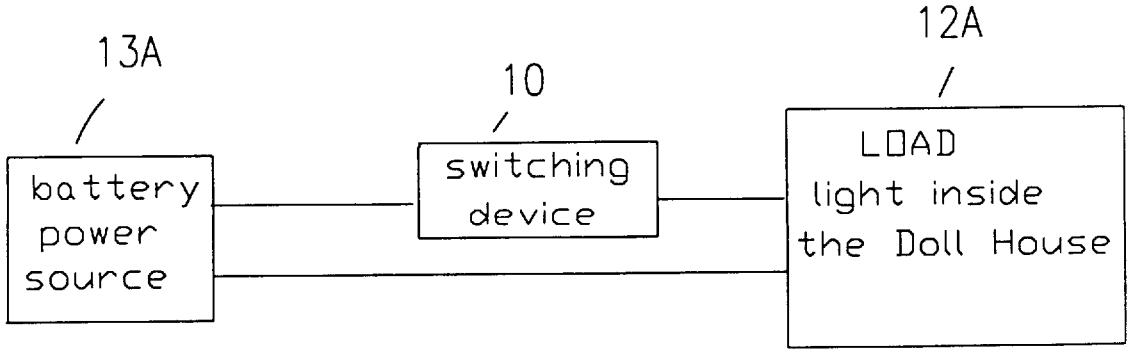
FIG. 2A is a schematic diagram of the light inside the Doll House.

Load in FIGS. 1 and 1A is the Christmas Tree Lights 12, load in FIGS. 2 and 2A is a light inside the Doll House 12A. Power source in FIGS. 1 and 1A is an AC power source 13, power source in FIGS. 2 and 2A is a battery power source 13A.

Figure 3:
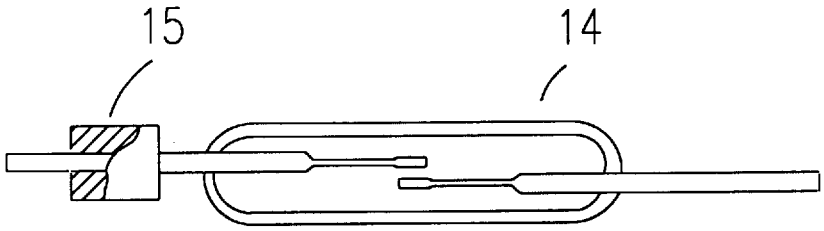
FIG. 3 shows a reed switch and a biasing magnet.

The switching device, which is shown in detail in FIG. 3, includes a normally open ordinary reed switch 14, and a ring-shaped biasing magnet 15. As was explained above, an ordinary reed switch is an external magnetic field hold-type reed switch.

Figure 3A:
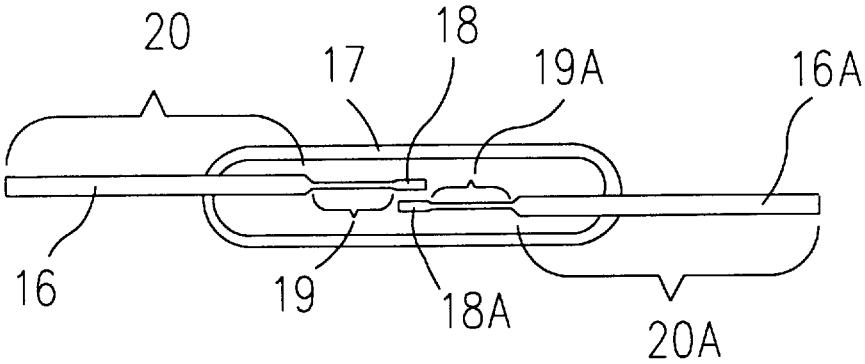
FIG. 3A shows a detail view of a reed switch.

Referring to FIG. 3A it can be seen that the reed switch 14 is a pair of blades 16 and 16A in magnetic material, such as 52-alloy, sealed in a glass tube 17 together with an inert gas (not shown). The blade 16 consists of a contact 18, a reed 19, and a lead 20. The blade 16A consists of a contact 18A, a reed 19A, and a lead 20A.

The biasing magnet is fixed on one of the leads of the reed switch, with its magnetic axis of polarity substantially parallel to the reeds 19 and 19A of the reed switch.

In other words, a biasing magnet is installed so that its magnetic strength in the area of the reed switch is greater than the drop-out value and less than the pick-up value of required magnetic strength for the reed switch. Or, we can say the blades 16 and 16A of the reed switch are located in the hold or hysteresis area. The wide range of that distance allows for a simple choice of location for the installation of the biasing magnet. For example, this distance between the biasing magnet produced by MASTER MAGNETICS, INC.—Alnico magnet, part No. A8RNG1001 and the glass tube of the reed switch RI-25 produced by Company Phillips has a range between 5 and 10 mm.

The magnetization pattern of the biasing magnet is shown in FIG. 4. North is magnetized on one face of the disc and South on the other. The biasing magnet can be installed on the lead, for example, with glue.

Figure 3B:
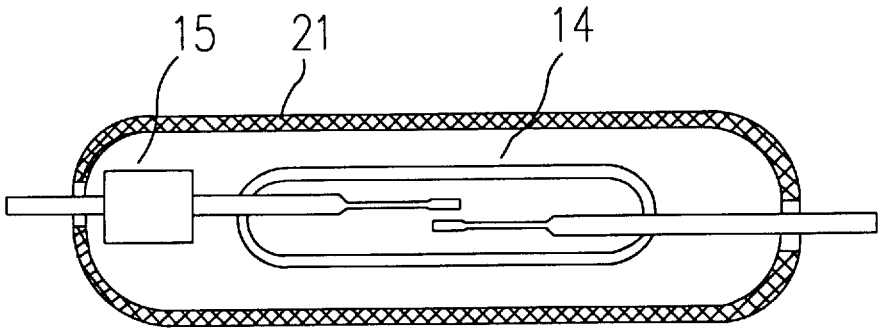
FIG. 3B shows a reed switch and a biasing magnet located inside housing.

The switching device can be installed inside a housing 21, shown in FIG. 3B. The housing can be made from any non-magnetic material, for example, from plastic tube.

The wand 11, shown in FIGS. 1, 2, 5, and 5A is used to operate the switching device. It is comprised of a normally graspable handle 22 and a permanent magnet 23 that is fixed inside handle 22 with its magnetic axis of polarity substantially parallel to the axis of the handle. The magnetization pattern of the rod-shaped wand magnet is shown in the FIG. 6. North is magnetized on one end and South on the other. The wand can be made of any suitable non-magnetic material with an ornament which would mark the positions of the wand magnet poles. The ornament may be shaped like a star and enhances the attractiveness of the wand.
For example, a white star can mark the same pole of the wand magnet as the pole of the biasing magnet located closer to the glass tube of the reed switch; and a blue star can mark the position of the opposite pole.

Operation—FIGS. 1 to 7

The operation of the switching device will be shown here.

Magnetic switch 10 is activated-closed by magnetic wand 11 and remains in closed position after removing the magnetic wand, when (a) the user brings the magnetic wand close to the lead of the reed switch with the installed biasing magnet 15, with the same wand magnet pole as the pole of the biasing magnet located closer to the glass tube of the reed switch; or (b) the user brings magnetic wand 11 close to the lead of the reed switch with no biasing magnet, with the magnet wand pole which is opposite to the biasing magnet pole located closer to the glass tube of the reed switch.

Magnetic switch 10 is deactivated—opened by the magnetic wand and remains in open position after removing the magnetic wand, when (a) the user brings wand 11 close to the lead of the reed switch with no biasing magnet, with the same wand magnet pole as the pole of the biasing magnet located closer to the glass tube of the reed switch; or (b) the user brings the magnetic wand close to the lead of the reed switch with the installed biasing magnet, with the magnetic wand pole which is opposite to the biasing magnet pole located closer to glass tube of the reed switch.

If the load current exceeds the current carrying capacity of the reed switch, the same switching device as shown in previous embodiment is used to switch on and off the input terminal of a source powered amplifying device such as a Triac or Power Mosfet.

Figure 7:
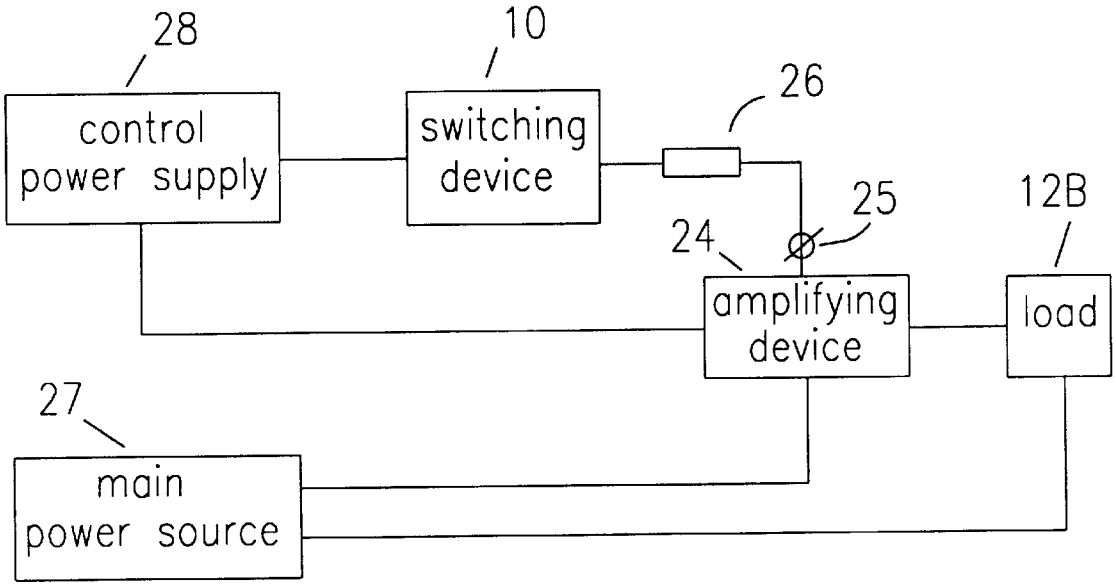
FIG. 7 is a schematic diagram showing connections of an amplifying device, a switching device, a main power source, a control power supply, and a load.

As shown in FIG. 7, an amplifying device 24 connects and disconnects load 12B to/from a main power source 27. The switching device 10 connects and disconnects a control power supply 28 to/from a control terminal 25 of the amplifying device through a current limiting resistor 26.

Figure 7A:
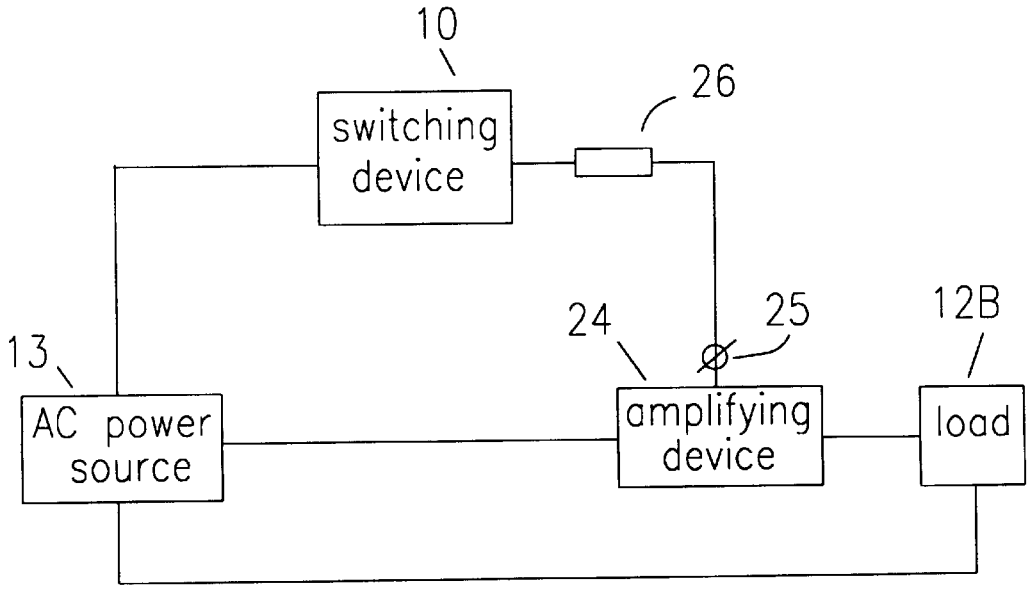
FIG. 7A is a schematic diagram showing connections of an amplifying device, a switching device, a power source, and a load.

As shown in FIG. 7A, one power source, for example AC power source 13, can be used as main power source 27 (FIG. 7) and control power supply 28 (FIG. 7).

The amplifying device can be installed in the toy construction or inside a plug connecting the amplifying device to the power source.

Conclusion, Ramifications, and Scope

Thus the reader will see that this invention is an inexpensive and very attractive device, that can be used for various electrical loads including Christmas Tree Lights and other electrical toys. This device comprises only a few very inexpensive components and it will be simple to produce.

While my above description contains a few specificities, these should not be construed as limitation on the scope of the invention, but rather as an exemplification of one preferred embodiment thereof many other variations are possible.

Figure 11:
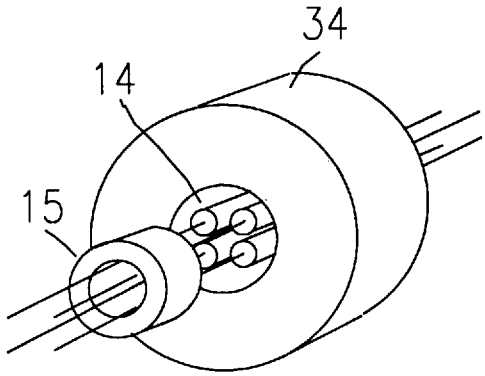
FIG. 11 shows the a latching relay with reed switches.

Described type of latching switch can be used as a latching relay, FIG. 11. FIG. 11 shows latching relay with four reed switches 14 and one common ring type biasing magnet 15 which is installed on the leads of all four reed switches. This biasing magnet provided equal biasing magnetic field for all four reed switches. All four reed switches are installed inside control coil 34. The coil provided external magnetic field for switching ON and OFF this latching relay. The relay latched ON or OFF depends on the direction of the pulse or DC current in the coil.

Figure 12:
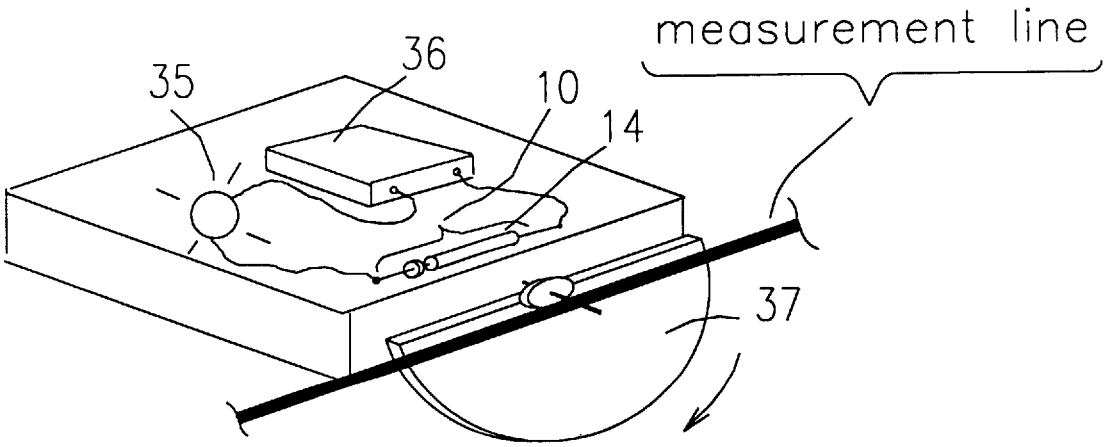
FIG. 12 shows the latching switch used to measure current.

Another application for this type of latching switch is the sensor direction of the DC current in the line. Very often engineers and technicians have to check direction of the current in the working DC line. The switching device shown in FIG. 12 can be used for this application. Signal light 35 gets voltage from power supply 36 through latching switch 10. Chopper 37 is installed between measurement line and latching switch. When latching switch 10 is located close to the DC line, reed switch 14 is ON. Chopper 37 has to be manually rotated. In this case the reed switch is ON and signal light 35 steadily lit if direction of the current in DC line provides external magnetic field the same direction of polarity as polarity of the biasing magnetic field. The reed switch is ON and OFF and signal light flashing, when direction of the current in DC line provides magnetic field with polarity opposite polarity of the biasing magnet.

The switching device may have another shape of the biasing magnet. For example, a bar shaped or rod shaped biasing magnet could be installed close to the reed switch with its magnetic axis of polarity substantially parallel to the reed of the reed switch. And in this case the distance between the biasing magnet and the glass tube of the reed switch has to provide the hold or hysteresis area for the reed switch.

The wand magnet may also have various shapes. For example, the bar-shaped magnet can be installed inside the wand.

Also, a flexible magnet can be used as the biasing magnet or as the wand magnet.

The switching device may operate in response to a magnetic field produced by a permanent magnet or by a field produced electromagnetically.

Thus the scope of the invention should be determined by the appended claims and their legal equivalents, rather than by the examples given.

I claim:

1. A switching means comprising:

a reed switch with soft magnetic material of the blades turned on and off by an external magnetic field of the direct current line;

a fixed biasing magnet located in the hysteresis area of said reed switch such that the magnetic field is slightly less than that required to close said reed switch.

2. The switching means of claim 1, wherein said reed switch is a center-gap-type reed switch with soft magnetic material of the blades.

3. The switching means of claim 1, wherein said reed switch is an offset-type-reed switch with soft magnetic material of the blades.

4. The switching means of claim 1, wherein between said reed switch and said direct current line installed chopper.

5. A switching means comprising:

a reed switch with soft magnetic material of the blades turned on and off by an external magnetic field of a coil or a permanent magnet;

a fixed biasing magnet located in the hysteresis area of said reed switch such that the magnetic field is slightly less than that required to close said reed switch.

6. The switching means of claim 5, wherein said reed switch is a center-gap-type reed switch with soft magnetic material of the blades.

7. The switching means of claim 5, wherein said reed switch is an offset-type reed switch with soft magnetic material of the blades.

8. The switching means of claim 5, wherein said biasing magnet is a ring type magnet.

9. The switching means of claim 8, wherein said biasing magnet fixed on the blades of more than one said reed switches; said reed switches installed inside a control coil.

10. The switching means of claims 1 or 5, wherein said biasing magnet has a bar shape.

11. The switching means of claim 1 or 5, wherein said biasing magnet has a rod shape.

12. A switching means for electrically connecting an electrical toy including Christmas tree lights to a power source comprising:

an normally open reed switch turned on and off by a magnetic field, a biasing magnet, fixed on the lead of said reed switch; said biasing magnet located at a distance from the glass tube of said reed switch such that its magnetic strength at the area of said reed switch has a value less than required for switching on of said reed switch and greater than switching off value of said switch, a magnetic wand means used for control of switching on and off of said reed switch by placement of said magnetic wand close to said reed switch; said wand comprising: a manually graspable handle and a magnet connected to said handle.

13. The switching means of claim 12, further including the housing where said reed switch and said biasing magnet are enclosed.

14. The switching means of claim 12 further including an amplifying means for electrically connecting an electrical load to main power source; a control terminal of said amplifying means is connected to a control power supply by said reed switch.

15. The switching means of claim 13, further including an amplifying means for electrically connecting an electrical load to a main power source; control terminal of said amplifying means is connected to a control power supply by said reed switch.

16. The switching means of claim 14, wherein one power source is used as said main power source and said control power supply.

17. The switching means of claim 15, wherein one power source is used as said main power source and said control power supply.

* * * * *